US009340984B2

(12) United States Patent
Chou

(10) Patent No.: US 9,340,984 B2
(45) Date of Patent: May 17, 2016

(54) MICRO LOCK MORTISE RIVETED JOINT FRAME TWO PLY SOLID WOOD HYBRID ENGINEERED FLOORING

(71) Applicant: Alan Lun Chou, City of Industry, CA (US)

(72) Inventor: Alan Lun Chou, City of Industry, CA (US)

( * ) Notice: Subject to any disclaimer, the term of this patent is extended or adjusted under 35 U.S.C. 154(b) by 0 days.

(21) Appl. No.: 13/952,639

(22) Filed: Jul. 28, 2013

(65) Prior Publication Data

US 2015/0191917 A1 Jul. 9, 2015

(51) Int. Cl.

| | |
|---|---|
| ***E04B 2/00*** | (2006.01) |
| ***E04F 15/04*** | (2006.01) |
| ***E04F 15/02*** | (2006.01) |

(52) U.S. Cl.

CPC ..... *E04F 15/045* (2013.01); *E04F 15/02038* (2013.01); *E04F 2201/0107* (2013.01); *E04F 2201/023* (2013.01)

(58) Field of Classification Search

CPC ..... E04F 15/045; E04F 15/02038; E04F 15/0215; E04F 2203/00; E04F 2201/0107; E04F 2201/023

USPC ..... 52/588.1, 796.1

See application file for complete search history.

(56) References Cited

U.S. PATENT DOCUMENTS

| | | | | | |
|---|---|---|---|---|---|
| 4,831,806 | A * | 5/1989 | Niese et al. | 52/391 |
| 5,040,582 | A * | 8/1991 | Hsu | 144/348 |
| 5,109,898 | A * | 5/1992 | Schacht | 144/350 |
| 5,113,632 | A * | 5/1992 | Hanson | 52/385 |
| 5,117,603 | A * | 6/1992 | Weintraub | 52/390 |
| 5,543,193 | A * | 8/1996 | Tesch | 428/68 |
| 5,736,218 | A * | 4/1998 | Iwata et al. | 428/107 |
| 5,736,227 | A * | 4/1998 | Sweet et al. | 428/192 |
| 5,738,924 | A * | 4/1998 | Sing | 428/68 |
| 6,023,900 | A * | 2/2000 | Stoehr et al. | 52/403.1 |
| 6,162,312 | A * | 12/2000 | Abney | 156/154 |
| 6,695,944 | B2 * | 2/2004 | Courtney | 156/252 |
| 6,763,643 | B1 * | 7/2004 | Mårtensson | 52/586.1 |
| 7,603,824 | B1 * | 10/2009 | Hartanto | 52/384 |
| 7,972,707 | B2 * | 7/2011 | Padmanabhan | 428/537.1 |
| 8,857,125 | B2 * | 10/2014 | Lu et al. | 52/581 |
| 2002/0152701 | A1 * | 10/2002 | Zhang et al. | 52/390 |
| 2004/0074190 | A1 * | 4/2004 | Lin et al. | 52/592.1 |
| 2005/0268571 | A1 * | 12/2005 | Magnusson | 52/590.2 |
| 2006/0070325 | A1 * | 4/2006 | Magnusson | 52/403.1 |
| 2007/0062153 | A1 * | 3/2007 | Li et al. | 52/796.1 |
| 2007/0251173 | A1 * | 11/2007 | Stokes | 52/403.1 |
| 2008/0184647 | A1 * | 8/2008 | Yau | 52/589.1 |
| 2009/0277128 | A1 * | 11/2009 | Chen | E04C 2/12 52/782.1 |
| 2011/0005159 | A1 * | 1/2011 | Lee | B32B 3/06 52/588.1 |
| 2011/0214377 | A1 * | 9/2011 | Tucker, Jr. | 52/403.1 |
| 2012/0317911 | A1 * | 12/2012 | Huang | 52/309.1 |
| 2014/0109507 | A1 * | 4/2014 | Dossche | B32B 21/04 52/588.1 |
| 2015/0050443 | A1 * | 2/2015 | Roy et al. | 428/58 |

* cited by examiner

*Primary Examiner* — Joshua J Michener
*Assistant Examiner* — Keith Minter
(74) *Attorney, Agent, or Firm* — Songfong T. Wong; Yang & Wang, P.C.

(57) ABSTRACT

Disclosed is a new type of two-ply solid hybrid wood flooring system that utilizes an improved, more dimensional and stable solid wood backing layer or foundation with continuous solid structural edge beams made out of many small pieces of finger jointed solid wood strips and bonded together in such a way which eliminates waste of raw material, uses less adhesive and yields the maximum structural stability. The present invention combines the dimensional stability characteristics of a traditional perpendicular-grain engineered flooring product with the benefit of the thickness of the traditional solid wood flooring.

10 Claims, 14 Drawing Sheets

(Exploded perspective view of the present invention)

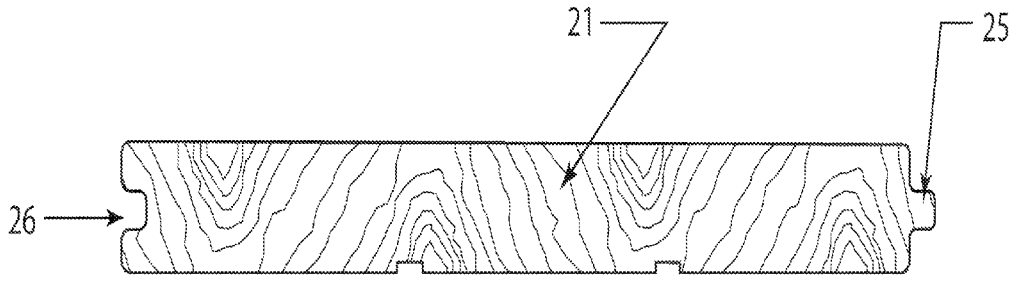
FIG. 1 (Prior Art -- Conventional solid wood flooring)
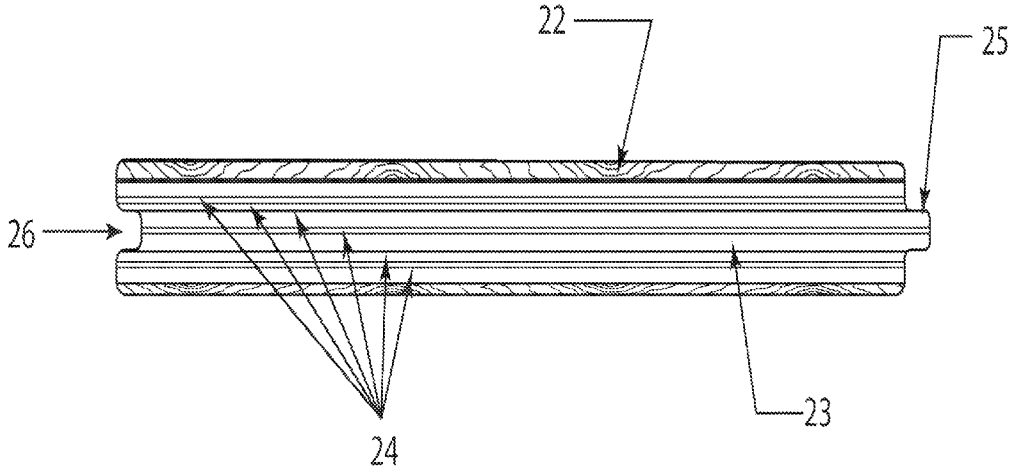
Prior Art
FIG. 2 (Conventional multi-layered engineered flooring)

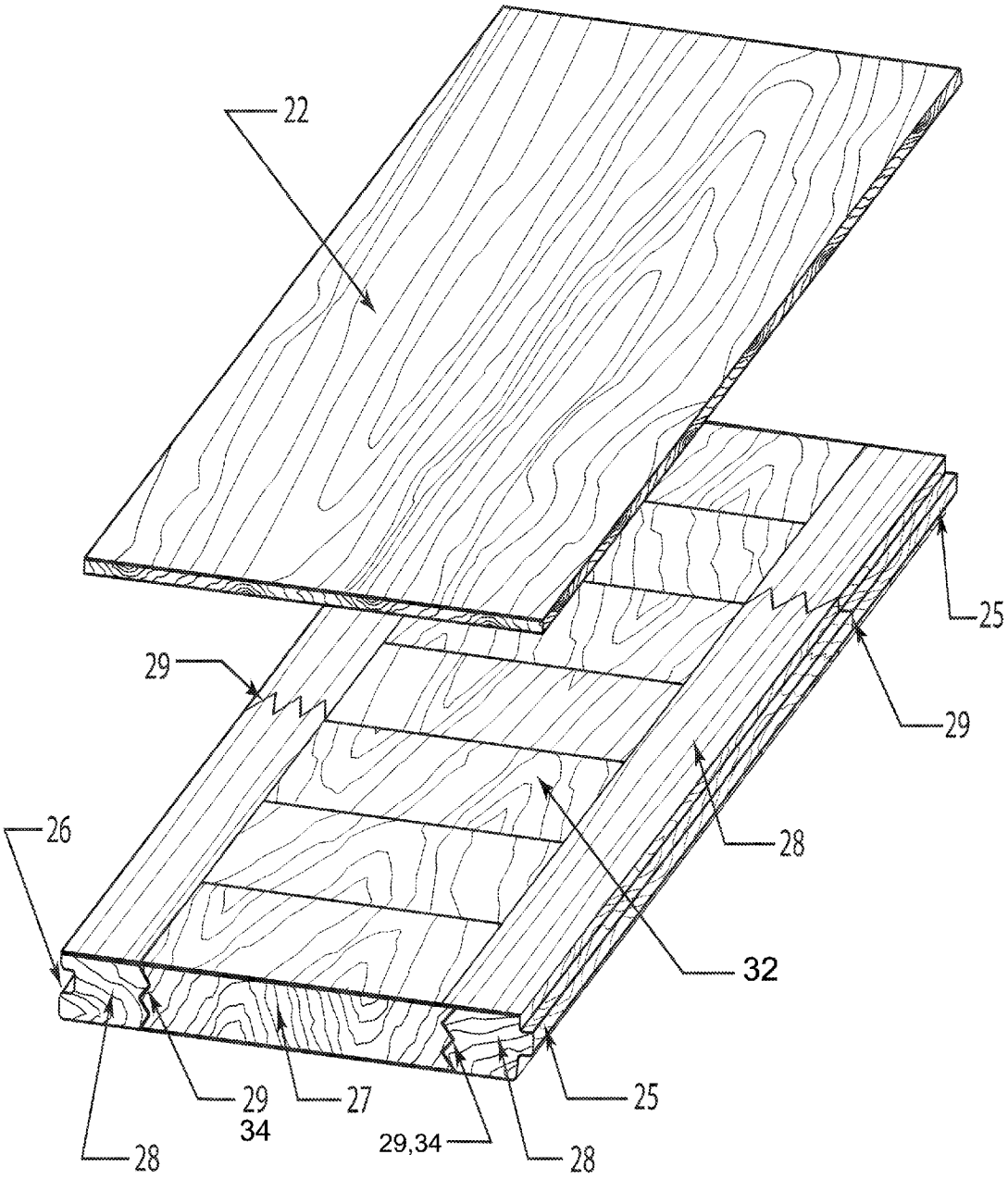
FIG. 3 (Exploded perspective view of the present invention)

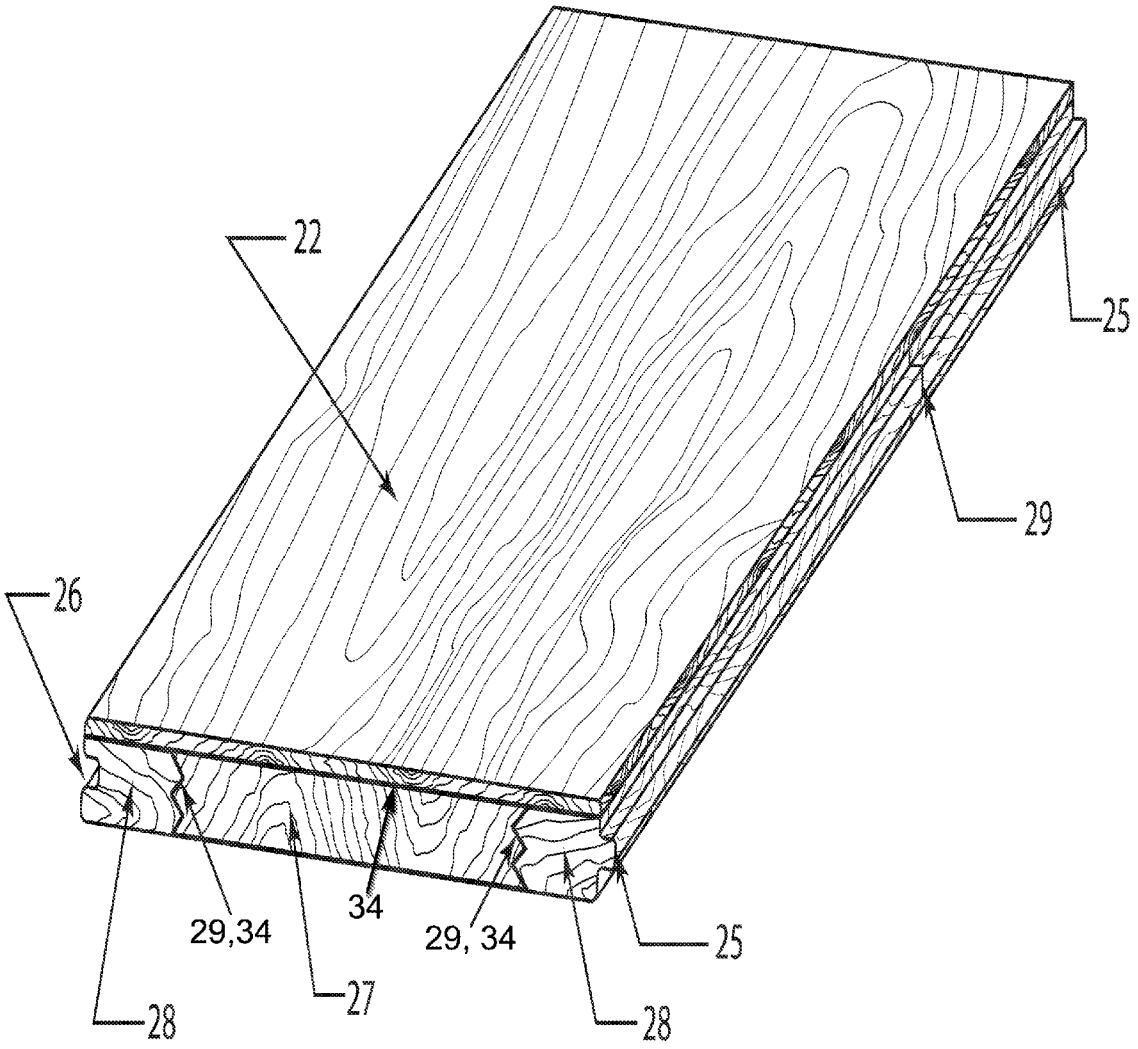
FIG. 4 (Isometric drawing of the present invention)

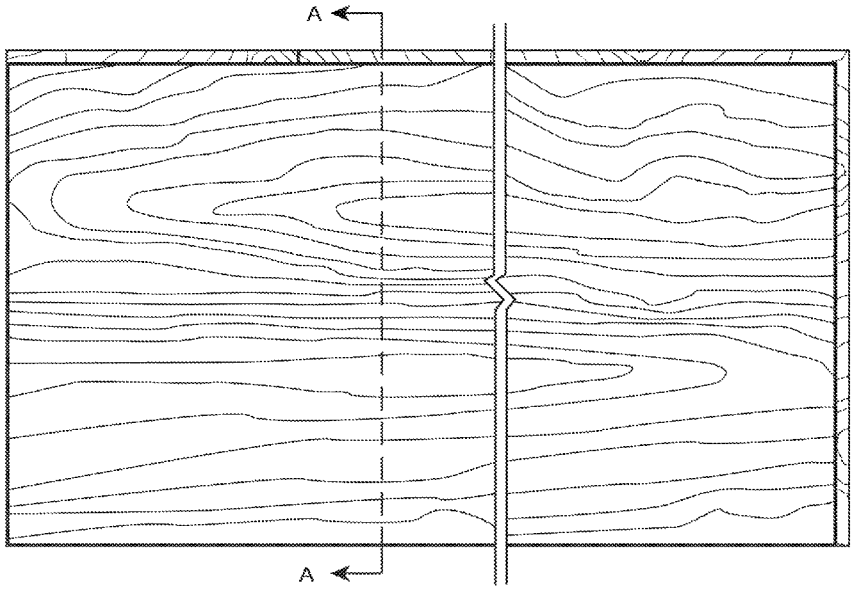
FIG. 5 (Top view of the present invention)
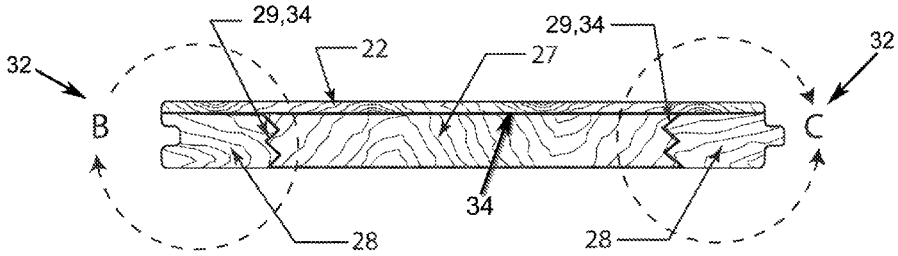
FIG. 5A (Section A-A)
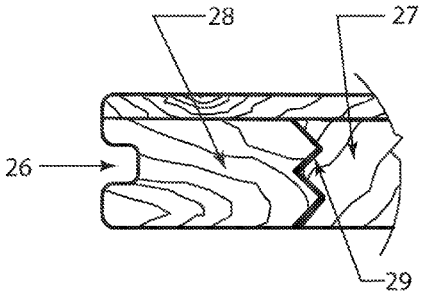
FIG. 5B
(Groove side of Edge Beam with Zigzag finger joint detail)
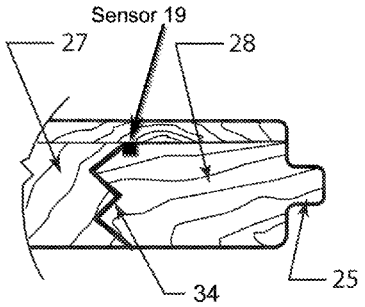
FIG. 5C
(Tongue side of Edge Beam with Zigzag finger joint detail)

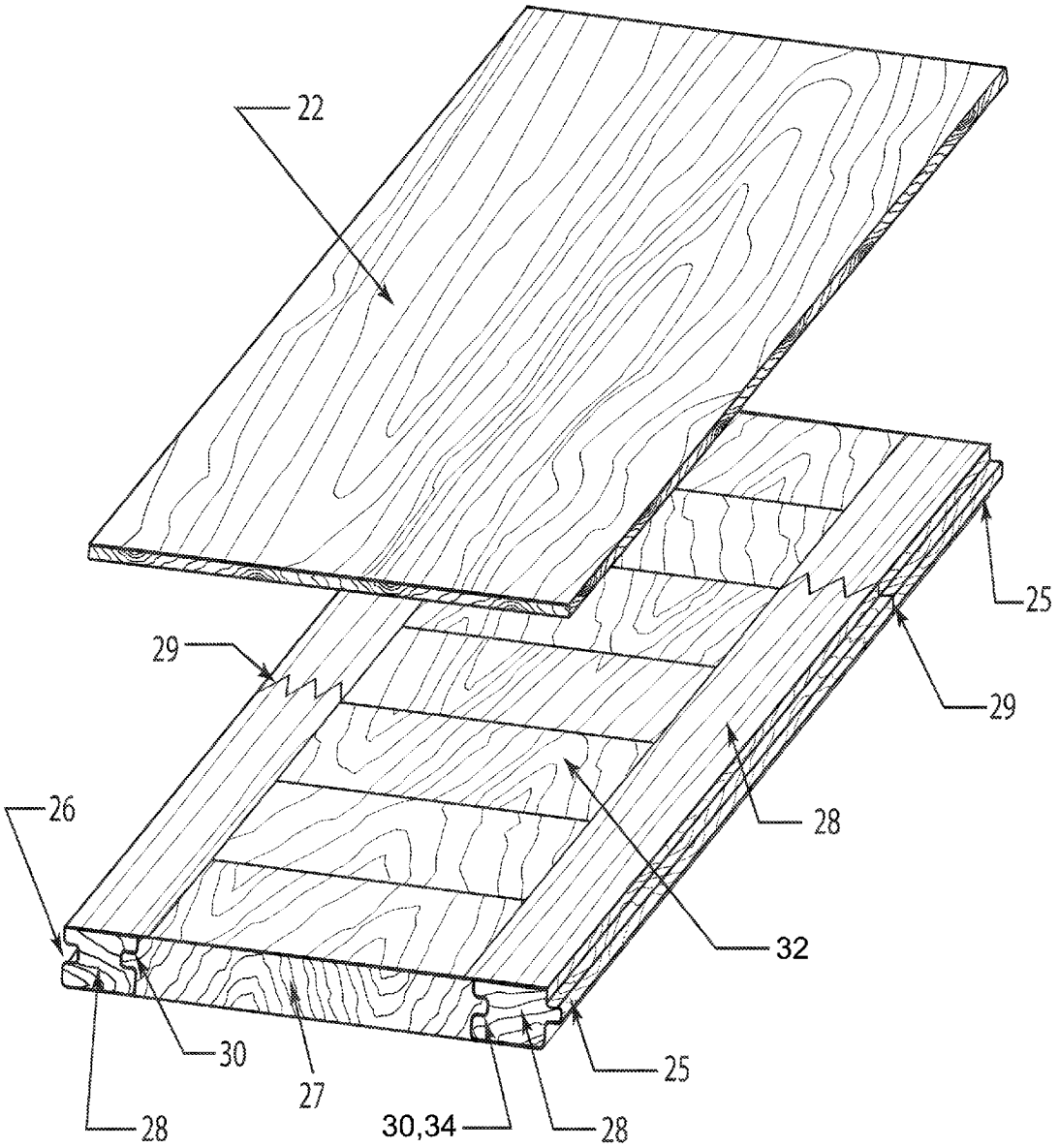
FIG. 6 (Exploded perspective view of the present invention)

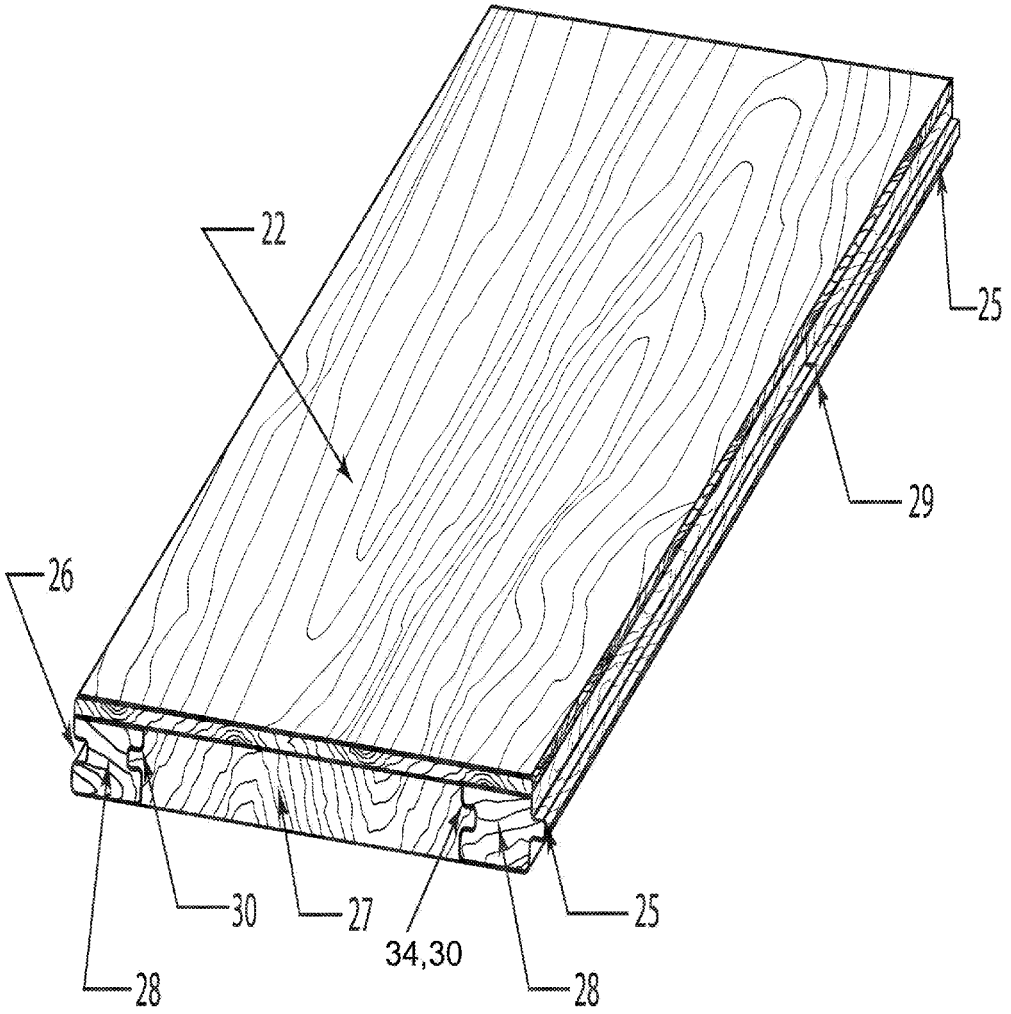
FIG. 7 (Isometric drawing of the present invention)

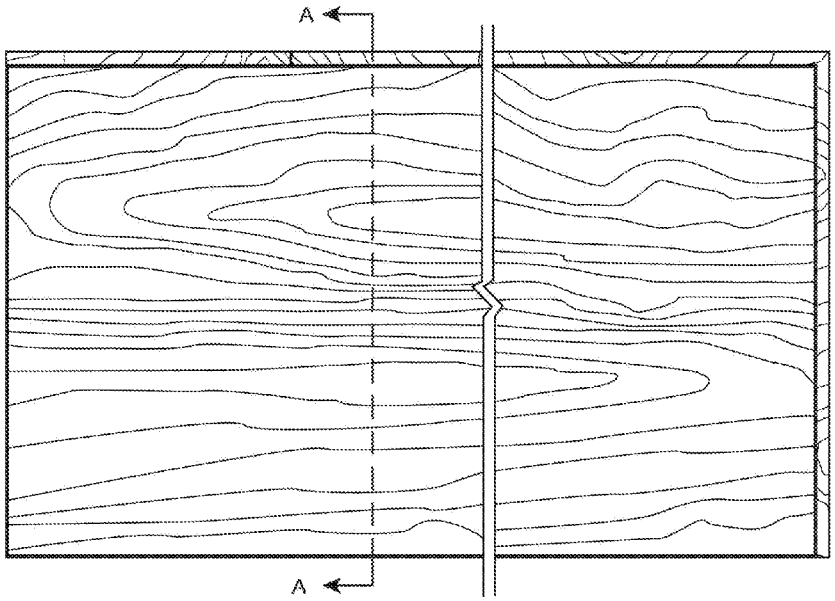
FIG. 8 (Top view of the present invention)
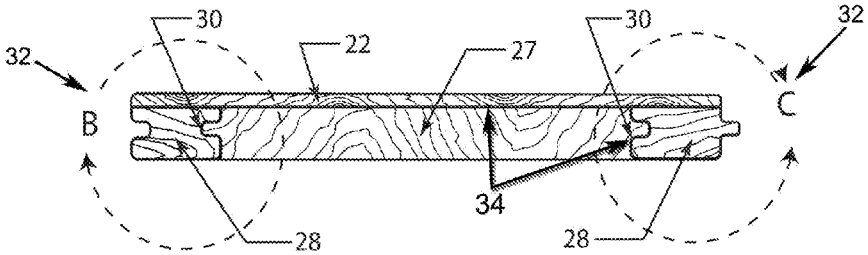
FIG. 8A (Section A-A)
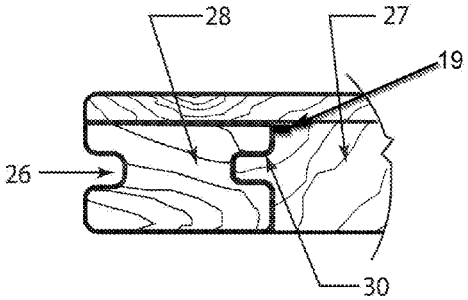
FIG. 8B
(Groove side of Edge Beam with Rounded edge T & G detail)
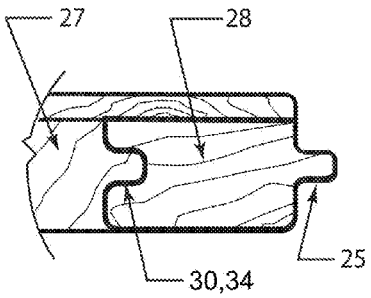
FIG. 8C
(Tongue side of Edge Beam with Rounded edge T & G detail)

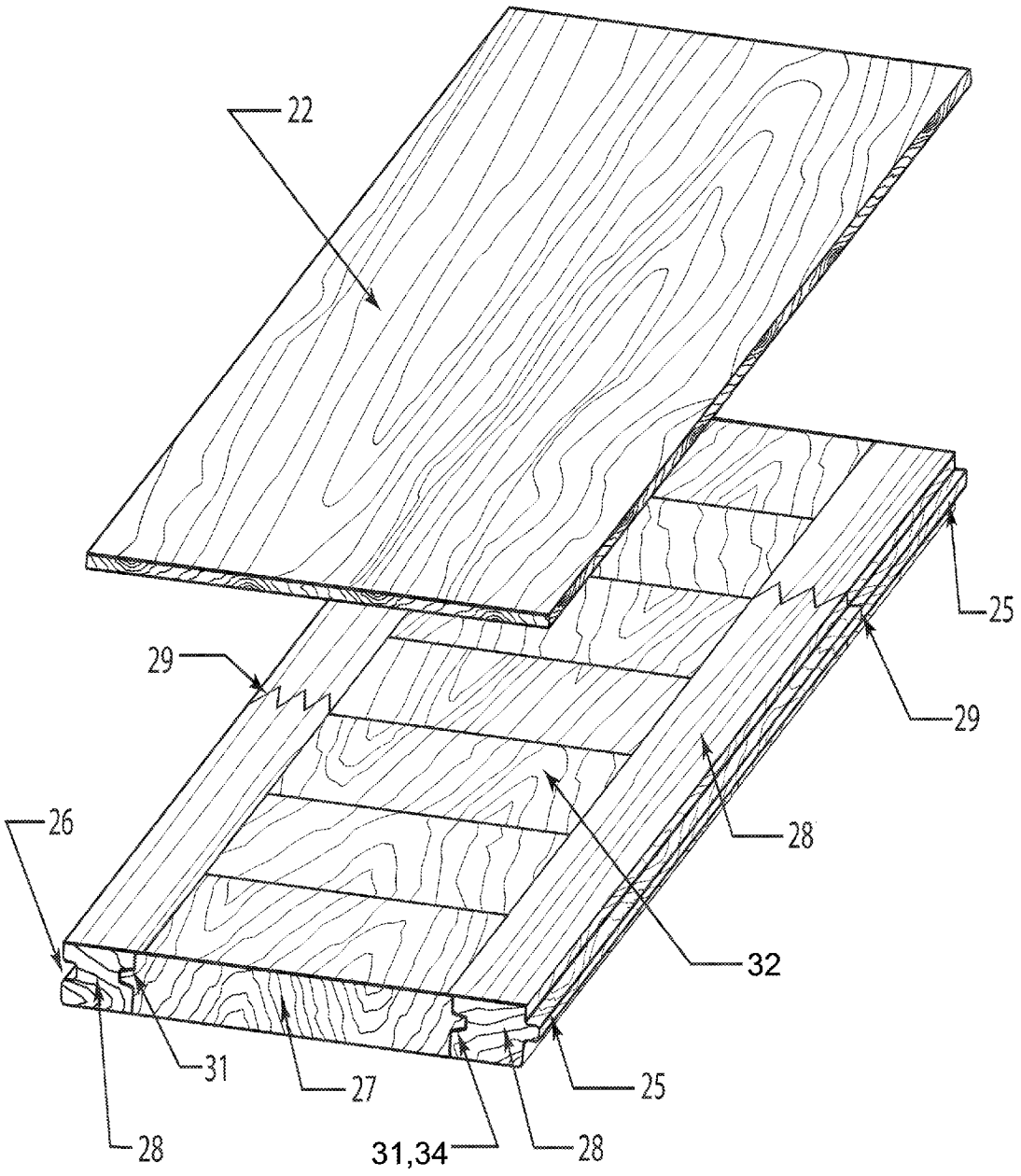
FIG. 9 (Exploded perspective view of the present invention)

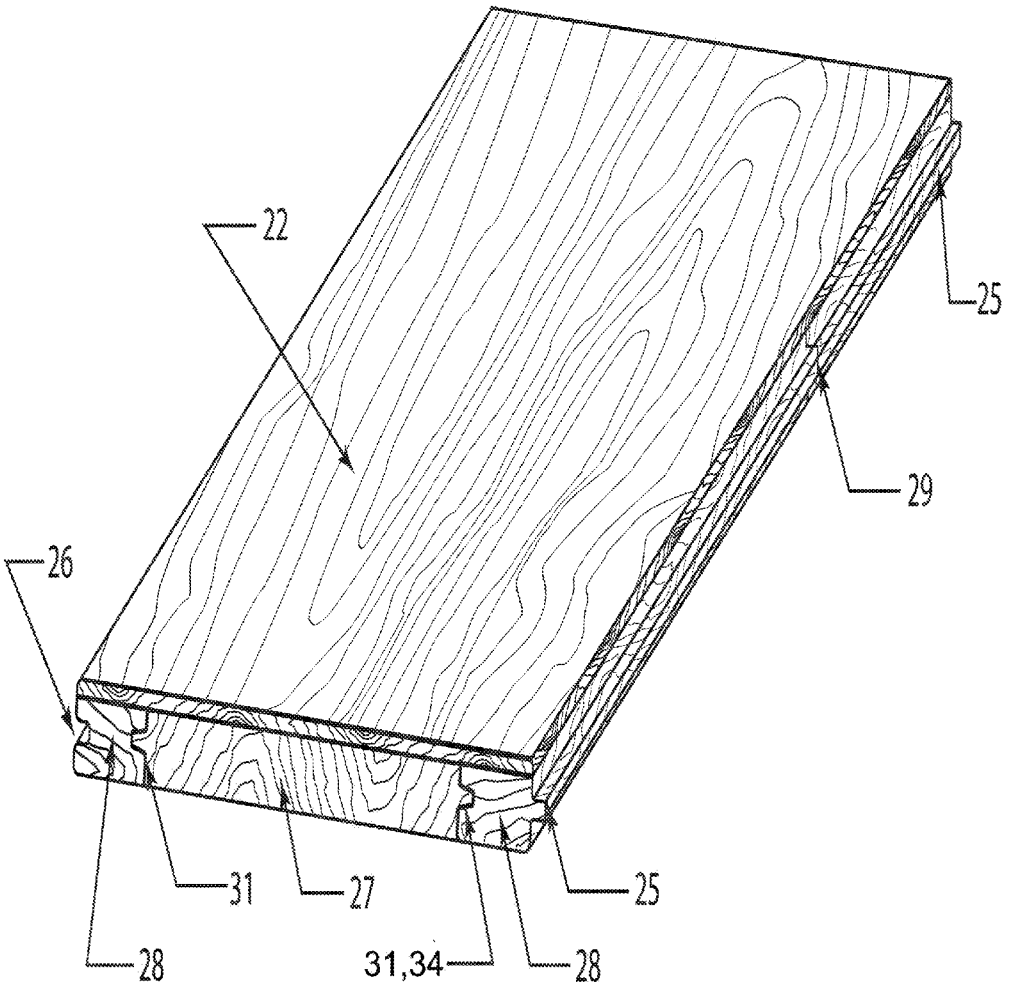
FIG. 10 (Isometric drawing of the present invention)

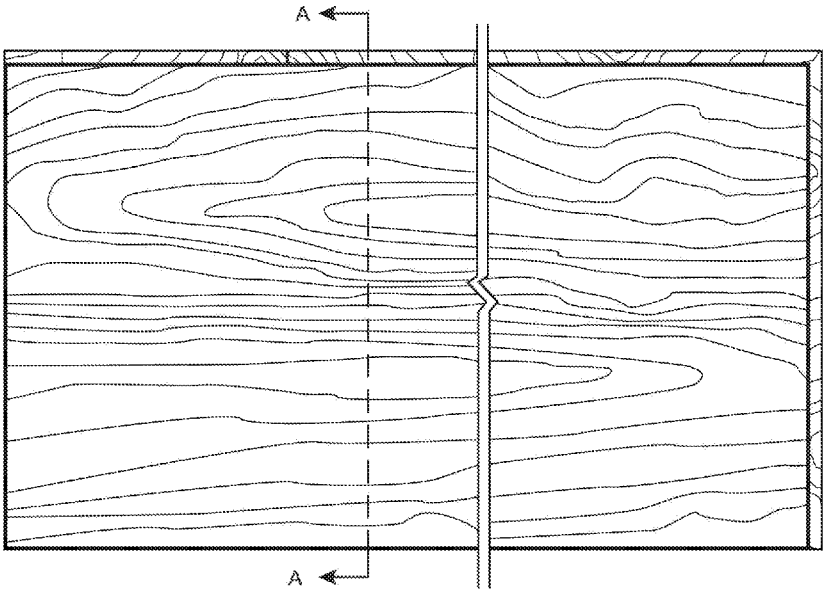
FIG. 11 (Top view of the present invention)
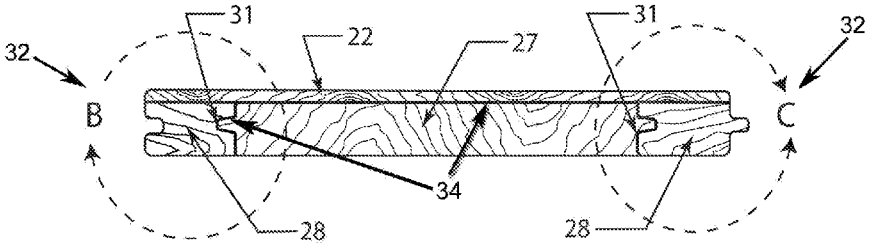
FIG. 11A (Section A-A)
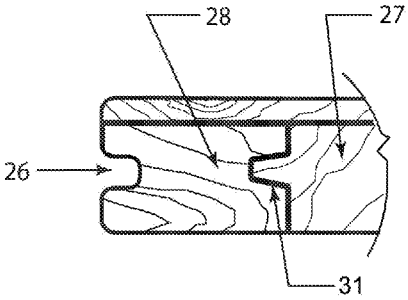
FIG. 11B
(Groove side of Edge Beam with modified edge V-shape T & G detail)
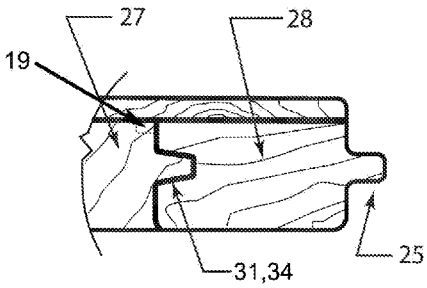
FIG. 11C
(Tongue side of Edge Beam with modified edge V-shape T & G detail)

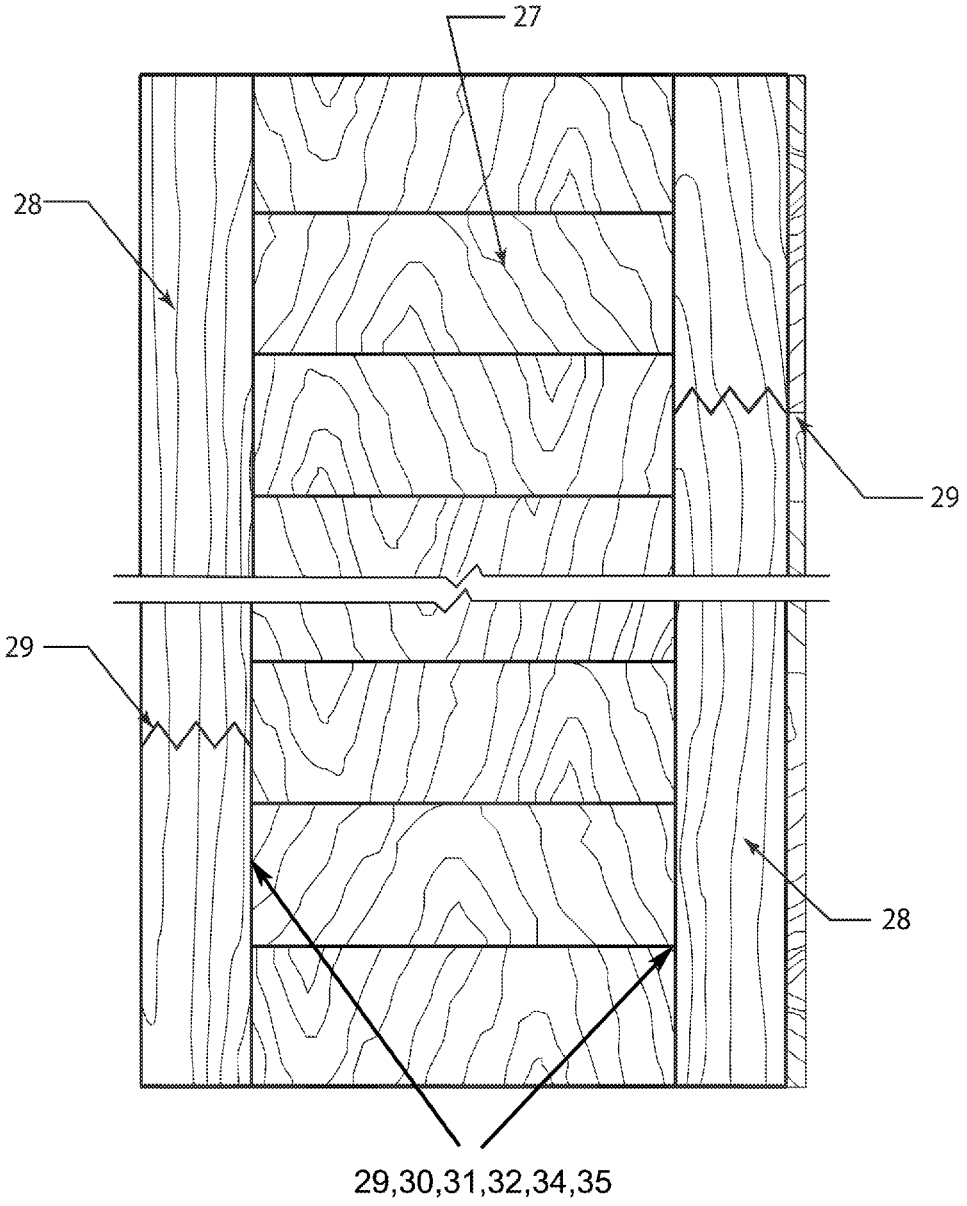
FIG 12 (Bottom view of the Wood Foundation Frame)

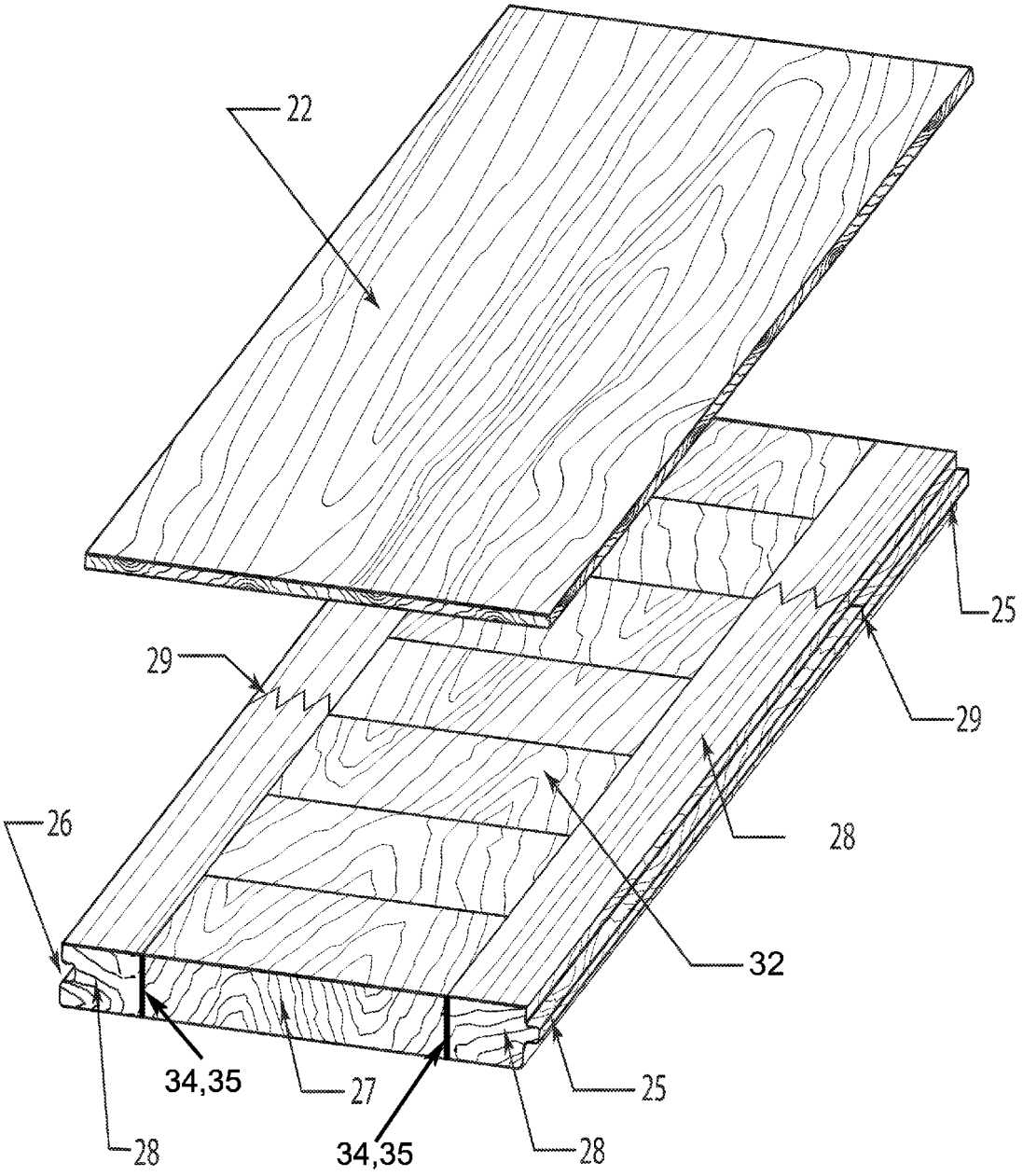
FIG.13 (Exploded perspective view of the present invention)

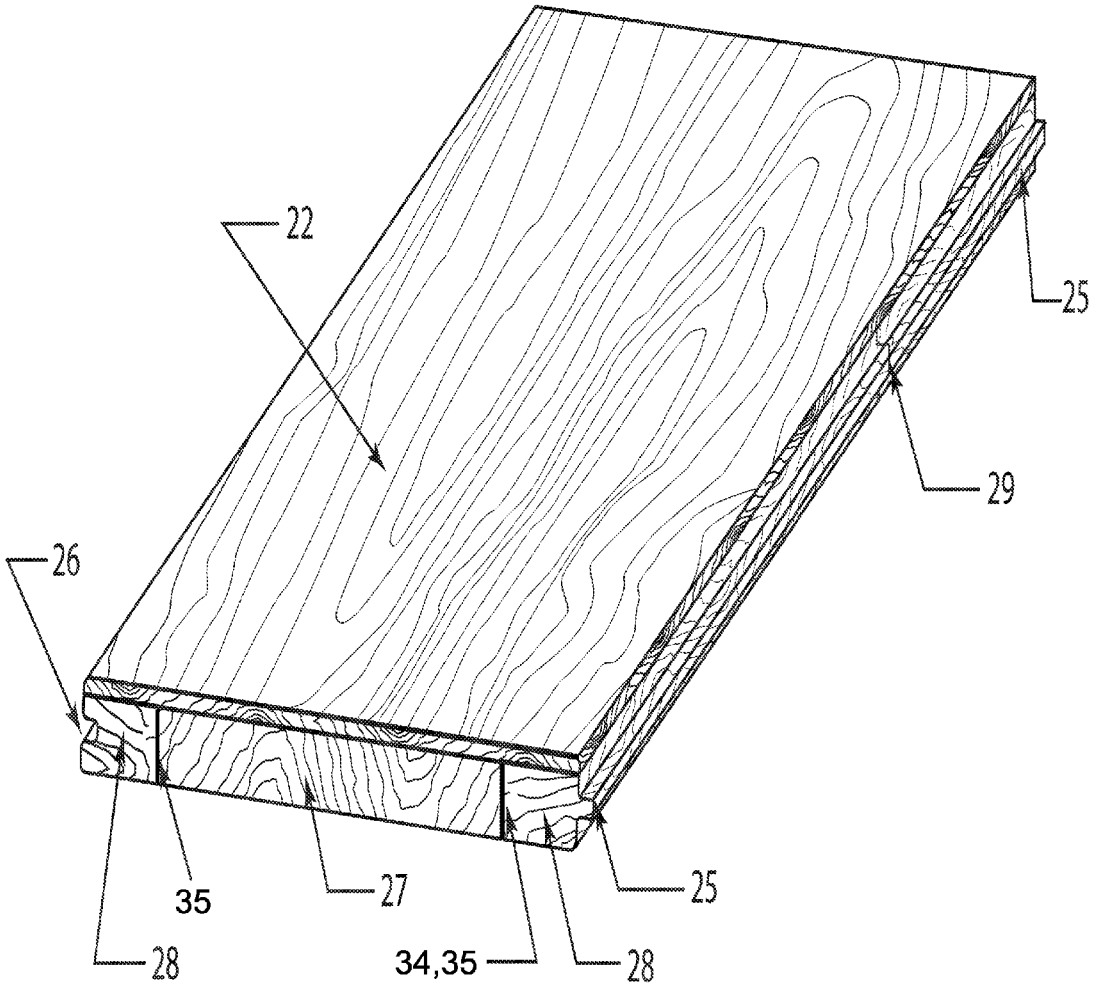
FIG.14 (Isometric drawing of the present invention)

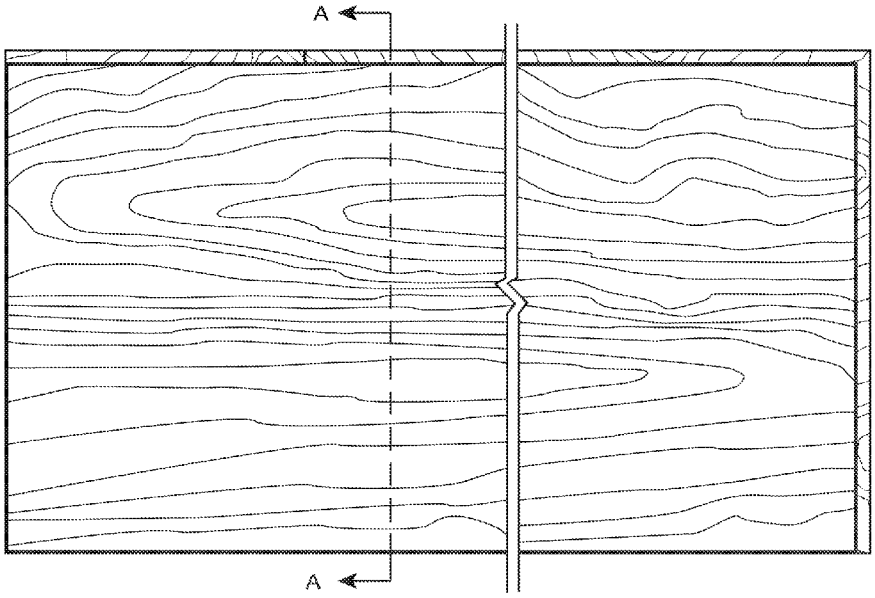
FIG.15 (Top view of the present invention)
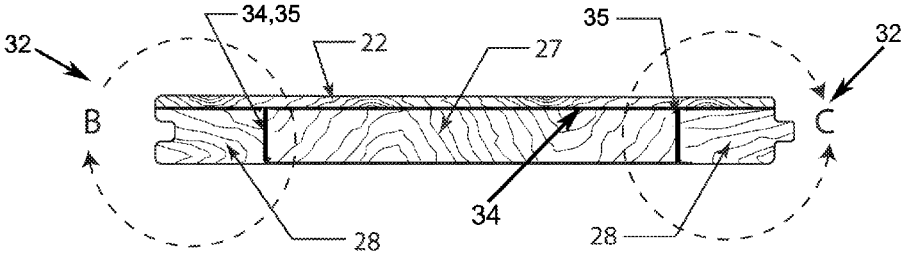
FIG.15A (Section A-A)
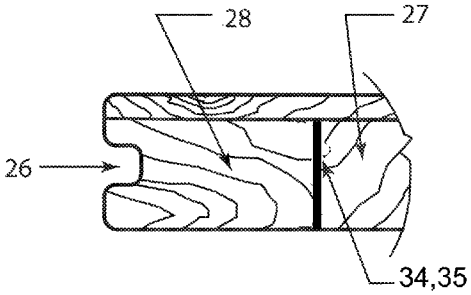
FIG. 15B
(Groove side of Edge Beam with Straight joint detail)
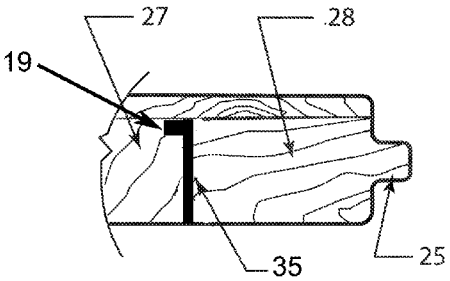
FIG. 15C
(Tongue side of Edge Beam with Straight joint detail)

MICRO LOCK MORTISE RIVETED JOINT FRAME TWO PLY SOLID WOOD HYBRID ENGINEERED FLOORING

CROSS-REFERENCE TO RELATED APPLICATIONS & CONTINUITY DATA

This application claims the benefit of provisional applications No. 61/682,165 and No. 61/693,065, hereby incorporated by reference in their entirety.

STATEMENT REGARDING FEDERALLY SPONSORED RESEARCH OR DEVELOPMENT

N/A

REFERENCE TO SEQUENTIAL LISTING, A TABLE, OR A COMPUTER PROGRAM LISTING APPENDIX SUBMITTED ON A COMPACT DISC

N/A

BACKGROUND OF THE INVENTION

The traditional solid wood flooring system shown in FIG. 1 consists of a single piece of solid wood machine profiled into a wood plank of various thicknesses and widths. The finished plank usually contains a "tongue" 25 on one side of the board and a "groove" 26 on the opposite side of the board (lengthwise). Making solid flooring generally requires larger sizes raw materials than the final products. This process generates a lot of waste lumber since smaller pieces of strips cannot be used. In addition, solid flooring is generally considered dimensionally unstable.

FIG. 1 is a cross-sectional view of the conventional solid wood flooring. The multi-ply engineered wood flooring system are usually manufactured with multiple layers (as many as eleven) of veneer of various thicknesses and glued together with the grain of the veneers running in perpendicular directions to form a final assembled product. The process of arranging the veneers (23) perpendicular to each other offers this type of flooring more dimensional stability when compared to the solids. However, this process utilizes adhesive chemicals to bond each layer of veneers together under pressure. Each layer of adhesive joint (24) could potentially fail and cause separation between the layers known in the industry as "delaminating" of the product. In addition, the amount and types of adhesive chemicals used to produce this type of engineered flooring could be harmful to human health.

FIG. 2 is a cross-sectional view of the traditional multi-layered engineered wood flooring. There is a need for a flooring product that reinforces sustainable forest product harvest practice methods, utilizes fewer raw materials, uses less adhesive chemical in the manufacturing process as well as possessing performance dimensional stability and aesthetic characteristics of traditional flooring planks. Previous attempts to create such flooring planks have included other 2-ply flooring with grain orientation running perpendicular to each other. These attempts, although similar, generally still do not offer great structural solutions to the common lengthwise "bowing" and widthwise "cupping" of the final finished products.

FIELD OF THE INVENTION

The present invention relates generally to wood flooring systems.

DESCRIPTION OF RELATED ART

The following Patents or Patent Publications are believed to be representative of prior attempts to solve the problem, none of which are herein stated to be prior art:

- U.S. Pat. No. 4,831,806, issued May 23, 1989;
- U.S. Pat. No. 5,040,582, issued Aug. 20, 1991;
- U.S. Pat. No. 5,109,898, issued May 5, 1992;
- U.S. Pat. No. Des. 355, 60 494, issued Feb. 14, 1995;
- U.S. Pat. No. 5,543,193, issued Aug. 6, 1996;
- U.S. Pat. No. 5,736,227, issued Apr. 7, 1998;
- U.S. Pat. No. 5,736,218, issued Apr. 7, 1998;
- U.S. Pat. No. 5,738,924, issued Apr. 14, 1998;
- U.S. Pat. No. 6,162,312, issued Dec. 19, 2000;
- U.S. Patent Publication No. 2002/0152701,50 published Oct. 24, 2002;
- U.S. Pat. No. 6,695,944, issued Feb. 24, 2004;
- U.S. Patent Publication No. 2004/0074190, published Apr. 22, 2004;
- U.S. Pat. No. 6,878,228, issued Apr. 12, 2005;
- U.S. Patent Publication No. 2005/0268571, published Dec. 8, 2005;
- U.S. Pat. No. 7,665,263 B2, issued Feb. 23, 2010;

SUMMARY OF THE INVENTION

An exploded perspective view is shown in FIG. 3, FIG. 6, FIG. 9 and FIG. 13. The present two-layer hybrid solid hardwood flooring plank seeks to provide a solution to the problems mentioned in part by laminating a piece of solid conventional hardwood flooring material (known as the wear layer, cover layer, or top layer) (22) to an improved, more dimensional, more stable, and in many embodiments solid wood backing layer or foundation (FIG. 12). The backing layer or foundation may have continuous solid structural edge beams (28) made out of many small pieces of finger jointed solid wood strips (27). These components are bonded together in a way which eliminates waste of raw material, uses less adhesive and yields the maximum structural stability. Furthermore the design may be accomplished with only a single adhesive layer The single top wear layer (22) is similar, in some respects, to many conventional engineered flooring products, and it may be composited of any wood species. The top wear layer (22) can be left unfinished or it can be stained and/or finished. Like the conventional solid or engineered flooring, this top wear layer (22) can be smooth, hand scraped, distressed or wire-brushed.

The new and improved single backing layer or foundation (FIG. 12) is made from small pieces of solid finger jointed wood strips (27), again in any wood species. These solid strips (27) of various lengths are finger jointed (29) lengthwise into two longer pieces of solid strips (28) each running in directions parallel under the outer edges of the top wear layer (22).

These two continuous finger jointed long strips of wood strips (34) containing a tongue (25) and a groove (26) form the plank's edges and also act as structural beams (28) (Edge Beams); Simultaneously the same pieces of smaller solid strips (27) of equal width and thickness, running in directions perpendicular to the top wear layer and the structural Edge Beams (28), are fastened together to the two continuous structural Edge Beams (28) by one of the different types of joint methods outlined by (29), (30), (31) and (35).

BRIEF DESCRIPTION OF THE DRAWINGS FIGURES

In general, unless otherwise described in each figure below, element 21 refers to pieces of solid wood flooring, 22 to the top-wear layer, 23 to wood veneers, 24 to adhesive joints, 25 to the tongue, 26 to the groove, 27 to the wood backing strips, 28 structural edge beams, 29 zig zag finger joints, 30 to the rounded edges tongue & groove connection, and element 31 to the modified V-shape tongue and groove connection, 19 to sensor, 32 to interstitial area, 34 to adhesive strips, and 35 to straight joint connection FIG. 1 illustrates a cross-sectional view of traditional solid wood flooring.

FIG. 2 illustrates a cross-sectional view of traditional multi-layer engineered flooring.

FIG. 3 is an exploded perspective view of the invention, showing the top wear-layer and also the improved Edge Beams backing layer or foundation with Finger-Joints Connection.

FIG. 4 illustrates an isometric drawing of a proposed finished plank manufactured with claims of this present invention.

FIG. 5 illustrates a top view of the present invention. FIG. 5-A is a sectional view of a flooring plank shown in FIG. 4. FIG. 5-B is a detailed view of a flooring plank shown in FIG. 4, showing the continuous structural Edge Beam profiled with the Groove and the zigzag finger joint connections. FIG. 5-C is a detailed view of a flooring plank shown in FIG. 4, showing the continuous structural Edge Beam profiled with the Tongue and the zigzag finger joint.

FIG. 6 is an exploded perspective view of the invention, showing the top wear-layer and also the improved Edge Beams backing layer or foundation with rounded edges T&G connections.

FIG. 7 illustrates an isometric drawing of a proposed finished plank manufactured with claims of this present invention.

FIG. 8 illustrates a top view of the present invention. FIG. 8-A is a sectional view of a flooring plank shown in FIG. 7.

FIG. 8-B is a detailed view of a flooring plank shown in FIG. 7, showing the continuous structural Edge Beam profiled with the Groove and the rounded edge T&G connection. FIG. 8-C is a detailed view of a flooring plank shown in FIG. 7, showing the continuous structural Edge Beam profiled with the Tongue and the rounded edge T&G connection.

FIG. 9 is an exploded perspective view of the invention, showing the top wear-layer and also the improved Edge Beams backing layer or foundation with the modified V-shape T&G connections.

FIG. 10 illustrates an isometric drawing of a proposed finished plank manufactured with claims of this present invention.

FIG. 11 illustrates a top view of the present invention. FIG. 11-A is a sectional view of a flooring plank shown in FIG. 10. FIG. 8-B is a detailed view of a flooring plank shown in FIG. 10, showing the continuous structural Edge Beam profiled with the Groove and modified V-shape T&G connections. FIG. 11B is an elevated side view of an edge beam with a modified V-shape.

FIG. 11-C is a detailed view of a flooring plank shown in FIG. 10, showing the continuous structural Edge Beam profiled with the Tongue and modified V-shape T&G connections.

FIG. 12 illustrates a bottom view of the present invention.

FIG. 13, showing the continuous structural Edge Beam profiled with straight joint connections.

FIG. 14, illustrates an isometric drawing of a proposed finished plank manufactures with claims of this present invention.

FIG. 15 illustrates a top view of the present inventions. FIG. 15-A is a section view of a flooring plank shown in FIG. 14. FIG. 15-B is a detailed view of a flooring plank shown in FIG. 14, showing the continuous structural Edge Beam profiled with Groove and the straight joint connection. FIG. 15-C is a detailed view of a flooring plank shown in FIG. 14, showing the continuous structural Edge Beam profiled with Tongue and the straight joint connection.

DETAILED DESCRIPTION OF THE PREFERRED EMBODIMENTS

A preferred embodiment is represented in the exploded perspective view of FIG. 3, showing the top wear layer (22) and also the improved structural Edge Beams (28) backing layer or foundation with Finger Joints Connection (29), and in FIG. 6, and FIG. 9. Straight Joint (35). Adhesive Strip (34). The two-layer, or two ply, hybrid solid hardwood flooring plank seeks to provide a solution to the problems mentioned in the background in part by laminating a piece of solid conventional hardwood flooring material (known as the wear layer, cover layer, or top layer) (22) to an improved, more dimensional, more stable, and more solid structure, of 100% wood (in most embodiments) as a backing layer or foundation (FIG. 12). The backing layer or foundation may be comprised of continuous solid structural edge beams (28) which in turn may be made out of many small pieces of finger jointed solid wood strips (27). These may be bonded together in such a way that eliminates waste of raw material, uses less adhesive and yields the maximum structural stability.

The single top wear layer (22) is similar to most conventional engineered flooring products. It can be composited of any wood species in widths ranging from 3 inches to 18 inches in certain embodiments. Thickness of the wear layers can range from 0.5 millimeters to 6 millimeters thick in certain embodiments. Lengths of the top wear layers are of various sizes from 4 inches up to 12 feet. The top wear layer (22) can be left unfinished or it can be stained and/or finished with any types of wood finishes in any color. Like the conventional solid or engineered flooring, this top wear layer (22) can be smooth, hand scraped, distressed or wire-brushed.

The new and improved single backing layer or foundation layer, shown in FIG. 12, may be comprised of small pieces of solid finger jointed wood strips (27), 6 mm to 15 mm thick in preferred embodiments, in any wood species. These solid strips of various lengths may be finger jointed (29) lengthwise into two longer pieces of solid strips (28) each running in directions parallel under the outer edges of the entire length of the top wear layer (22). These two continuous shaped long strips, or edge beams, of wood with tongue (25) and groove (26) form the plank's edges and also act like structural beams (28) (Edge Beams) Simultaneously the same species of smaller solid strips (27) of equal widths and thicknesses, running in directions perpendicular to the top wear layer (22) and the structural Edge Beams, are fashioned together to the two continuous structural Edge Beams (28) by one of the different joint methods, (29), (30), (31) and (35) as seen in FIG. 5A-C, FIG. 8 A-C FIG. 11 A-C and FIG. 15 A-C. a.) Finger joint Connections 29. FIG. 5A-C. b) Rounded edges Tongue and Groove connections 30. FIG. 8A-C. c.) Modified V-shape edges Tongue and Groove connections 31. FIG. 11A-C. d) straight joint connections 35. FIG. 15 A-C. This improved backing layer with the continuous structure Edge Beams 28 solves the inherent "cupping" and "bowing" problems when compared to other types of two-layer flooring systems.

This unique design utilizes a single adhesive layer which is a major distinction from other engineered hardwood flooring schemes. As shown in FIG. 6, each interstitial area (32)

between the component pieces, the edge beam (28), the solid wood backing strips, the cover layer, is accessible by a single layer of adhesive strips (34). That is, adhesive strips (34) that is placed in the interstitial area (32) between Edge Beam (28) and the solid backing strips (at point (29) in FIG. 3, or at point (30) in FIG. 6) is in contact with any adhesive strips (34) that may be placed between the backing layer and the cover layer (the area around (27) in FIG. 6). Each interstitial area (32) between component pieces may make connection with another interstitial area (32) and so on such that a single layer of adhesive may connect the system. This has a number of advantages. Delaminating with the current invention requires failure of 100% of the adhesive layers whereas in multiple adhesive layers designs delaminating may occur with as little as 5 or 10% of the adhesive layers failing. Moreover, given that the adhesive is placed within a single layer, either as one continual body of applied adhesive or in a series of dollops, a higher level of quality control is enabled. Consistency in the nature of the adhesive or its application is also much easier to achieve. Further monitoring of the adhesive, it's characteristics or application, is much more easily achieved given the single layer it resides in. In cases where a solid layer of adhesive is applied, as opposed to in spots or dollops, a sensor may even be applied to monitor its qualities. Additionally, preformatted and pre-shaped adhesive strips 34 may be deployed within the interstitial area of the flooring system. A sensor 19 is in contact with the adhesive layer.

In the various embodiments, the hardwood flooring system disclosed herein may be nailed or stapled (or other means known in the art) directly to a wood substrate, it can be glued directly to a concrete substrate and it can also be installed as a floating system on top of any substrate, even over radiant heated floor systems.

The phrase "in one embodiment" is used repeatedly. The phrase generally does not refer to the same embodiment; however, it may. The terms "comprising," "having" and "including" are synonymous, unless the context dictates otherwise. The following illustrations of various embodiments use particular terms by way of example to describe the various embodiments, but this should be construed to encompass and provide for terms such as "method" and "routine" and the like.

Various aspects of the illustrative embodiments will be described using terms commonly employed by those skilled in the art to convey the substance of their work to others skilled in the art. However, it will be apparent to those skilled in the art that the embodiments described herein may be practiced with only some of the described aspects. For purposes of explanation, specific numbers, materials and configurations are set forth in order to provide a thorough understanding of the illustrative embodiments. However, it will be apparent to one skilled in the art that the embodiments described herein may be practiced without the specific details. In other instances, well-known features are omitted or simplified in order not to obscure the illustrative embodiments.

The characteristics and utilities of the present invention described in this summary and the detailed description below are not all inclusive. Many additional features and advantages will be apparent to one of ordinary skill in the art given the following description. There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, nor is it intended to be limiting as to the scope of the invention in any way. The characteristics and utilities of the present invention described in this summary and the detailed description below are not all inclusive. Many additional features and advantages will be apparent to one of ordinary skill in the art given the detailed description.

What is claimed is:

1. A two ply solid hardwood flooring system consisting of:

a top wear layer;

a layer of wood foundation having:

two continuous structural edge beams; and backing strips of equal widths and thicknesses running in directions perpendicular to the top wear layer and the structural edge beams and jointed to the structural edge beams by a joint;

a first interstitial area configured to at least partially fasten said layer of wood foundation and the top wear layer together, the first interstitial area defined by a generally nonhomogeneous layer, the first interstitial area further configured to create friction and coupling surfaces between said layer of wood foundation and the top wear layer; and;

a second interstitial area located at said joint configured to at least partially fasten the edge beams and backing strips together, the second interstitial area defined by a generally nonhomogeneous layer, the second interstitial area further configured to create friction and coupling surfaces between the structural edge beams and the backing strips; and;

at least one preformatted adhesive strip disposed to position within the first and second interstitial areas, and formatted to said joint, the at least one preformatted adhesive strip configured to help adhere the layer of wood foundation to the top wear layer and the structural edge beams to the backing strips, whereby the at least one preformatted adhesive strip is a separate component from the first and second interstitial areas.

2. The system of claim 1, wherein the said structural edge beams are comprised of a plurality of micro lock mortise riveted joint wood strips.

3. The system of claim 1, wherein the said backing strips are comprised of solid wood or a plurality of micro lock mortise riveted joint wood strips.

4. The system of claim 1, wherein said two ply solid hardwood flooring system is secured to a wood substrate, a concrete substrate, secured as a floating floor above a substrate, or secured above a substrate with radiant heated floor components.

5. The system of claim 1, wherein the at least one preformatted adhesive strip is comprised of pre-shaped adhesive strips to accommodate said joints.

6. The system of claim 1, wherein the two structural edge beams and backing strips are comprised of solid wood or waste wood scraps.

7. The system of claim 1, wherein the top wear layer has a thickness between 0.5 mm and 6 mm, a width between 3 inches and 18 inches, and a length between 4 inches and 12 feet.

8. The system of claim 1, wherein the said layer of wood foundation is comprised of wood strips between 2 mm to 20 mm thick.

9. The system of claim 1, further including a sensor, the sensor configured to monitor the qualities of the at least one preformatted adhesive strip.

10. A two ply wood flooring system consisting of:

a plurality of wood strips configured to be jointed at two opposite ends, the jointed ends connecting to a structural edge beam; the structural edge beam having a groove or a tongue on a first side, a straight joint, or a finger joint or tongue or groove joint on an opposite side connecting to the plurality of wood strips, and the straight joint, or tongue or the groove joint on the opposite side of said wood strips connecting to a complementary straight joint, tongue or a complementary groove on a subsequent structural edge beam;

a cover layer;

a first interstitial area configured to at least partially fasten the structural edge beams and the cover layer together, the first interstitial area defined by a generally nonhomogeneous layer, the first interstitial area further configured to create friction and coupling surfaces between the structural edge beam and the cover layer; and a first at least one preformatted adhesive strip disposed to position within the first interstitial area, the first at least one preformatted adhesive strip configured to help adhere the structural edge beams to the cover layer, whereby the first at least one preformatted adhesive strip is a separate component from the first interstitial area;

a second interstitial area configured to at least partially fasten the structural edge beam and the plurality of wood strips together, the second interstitial area defined by a generally nonhomogeneous layer, the second interstitial area further configured to create friction and coupling surfaces between the structural edge beam and the plurality of wood strips; and a second at least one preformatted adhesive strip disposed to position within the second interstitial area, the second at least one preformatted adhesive strip configured to help adhere the structural edge beam to the plurality of wood strips, whereby the second at least one preformatted adhesive strip is a separate component from the second interstitial area.

* * * * *